United States Patent [19]

Smith

[11] Patent Number: 4,728,073

[45] Date of Patent: Mar. 1, 1988

[54] FORMWORK FOR FORMING RESERVOIRS AND POOLS

[76] Inventor: Brian R. Smith, P.O. Box 4336, Darwin, N.T., Australia, 5790

[21] Appl. No.: 863,947

[22] Filed: May 16, 1986

[30] Foreign Application Priority Data

May 20, 1985 [AU] Australia ..... PH00637
Oct. 1, 1985 [AU] Australia ..... PH02691

[51] Int. Cl.[4] ..... E04G 11/10

[52] U.S. Cl. ..... 249/189; 249/10; 249/17; 249/179; 249/219 R; 249/DIG. 3

[58] Field of Search ..... 249/3, 4, 5, 10, 11, 249/17, 165, 179, 182, 189, 153, 183, 219 R, DIG. 3; 264/31, 32; 425/59

[56] References Cited

U.S. PATENT DOCUMENTS 853,955 5/1907 Blaw ..... 249/182
853,956 5/1907 Blaw ..... 249/182
1,167,797 1/1916 Clawson ..... 249/179
4,060,946 12/1977 Lang et al. ..... 249/DIG. 3
4,619,433 10/1986 Maier ..... 264/32

FOREIGN PATENT DOCUMENTS 2426708 12/1975 Fed. Rep. of Germany ..... 249/17

*Primary Examiner*—Jay H. Woo
*Assistant Examiner*—James C. Housel
*Attorney, Agent, or Firm*—Murray and Whisenhunt

[57] ABSTRACT

Formwork (15) for moulding walls of reservoirs in any desired curved configuration. The formwork utilizes a flexible panel (18) having a form surface (17) on one side against which the reservoir wall may be moulded and connector means (37) on the other side for connecting adjustable bracing (36) thereto for holding the formwork in position. The bracing may be adjusted to vary the curvature of the formwork.

5 Claims, 9 Drawing Figures

FORMWORK FOR FORMING RESERVOIRS AND POOLS

This invention relates to improved formwork for forming reservoirs.

In particular this invention relates to on-side construction of reservoirs from reinforced concrete, however the formwork of the present invention can also be used as a mould for other construction materials. For illustrative purposes only, reference will be made hereinafter to its application to reinforced concrete pools, tanks and reservoirs.

Free form inground concrete pools are popular because of the variety of irregular shapes, such as kidney shapes, which may be constructed. In recent times the popularity of free form inground concrete pools has increased and the construction of conventional rectangular pools has decreased even though the latter type of pools are generally more easily constructed using accurately set up formwork to achieve the desired pools shape. Such methods at present also have the advantage that plumb walls can be formed which can be easily tiled. Furthermore the steel reinforcing mesh used to reinforce the concrete can be accurately placed to ensure adequate concrete cover of all reinforcement.

At present kidney shaped and other free form pools are formed by spraying concrete onto the walls of an excavation dug to the required shape. The exposed surface of the concrete is hand trowled to achieve the finished shape. The concrete may be sprayed about pre-placed reinforcing mesh or the concrete may incorporate pre-mixed steel fibre reinforcing. In either case it is difficult to ensure adequate concrete coverage for all of the steel reinforcing and thus such pools may deteriorate in use, especially if used to contain salt water. In addition to this problem, excess concrete is frequently used to achieve the desired shape since it is difficult to form the excavation to the exact required shape.

To date it has not been practical to provide internal formwork for such irregular shaped pools because the expense of arranging conventional formwork for such irregular wall shapes significantly increases the cost of construction of the pool. Curved formwork is used to form concrete tanks. However, this requires the use of relatively heavy pre-shaped formwork and considerable effort to erect the formwork and to dismantle the formwork after the poured concrete has reached a suitable hardness.

This invention aims to alleviate the abovementioned disadvantages associated with the present methods of constructing and to provide formwork which may readily erected. Other objects and advantages of this invention will hereinafter become apparent.

With the foregoing and other objects in view, this invention in one aspect resides broadly in formwork assembly which a wall may be moulded, including an elongated flexible panel having a form surface at one side of the panel and a plurality of connector means spaced along the opposite side of the panel and locating means engageable with said connector means for holding said panel in a selected configuration. The locating means may be in the form of spikes adapted to be driven into the ground to hold the panel in the desired configuration. Preferably however, the locating means comprises a plurality of ties rods each or some of which may be length adjustable if desired and each being adapted to extend between a pair of said spaced connector means so as to hold the respective flexible panel assembly portion intermediate said connector means in a selected bowed or curved configuration. Preferably the tie rods are placed so as to overlap the adjacent tie rod or rods. A plurality of such tie rods may be used and positioned so as to hold respective panel portions in outwardly bowed shapes (internal curves), or inwardly bowed shaped (external curves) as required. The flexible panel assembly may be formed of plastics material, such as fiberglass reinforced plastics material, or of metal and it may be formed in a continuous length or in modules adapted to be connected together to form the required length. The flexible panel assembly may be continuous if desired and adapted to be stored in a roll.

Preferably the connector means provide connections for the tie rods at positions intermediate the upper and lower edges of the flexible panel and at the side thereof remote from said form surface. The flexible panel may be provided with stiffeners which form respective top connections adjacent the upper edge of the flexible panel to enable further form panels to be supported in spaced relationship with the flexible panel whereby a selected width flange may be formed around the top of the wall between the form panel and the flexible panel. This flange may be in the form of a reinforced bond beam extending continuously around the reservoir wall and if desired to form panels may be flexible to enable them to conform to the shape of the flexible panel. For this purpose the stiffeners may include a fork like connector having an intermediate leg or prong engageable in a socket formed in the wall of the flexible panel and an upstanding stem portion which extends above the wall to provide said top connection.

In another aspect this invention resides in a method of constructing a wall portion of an inground concrete reservoir including: forming an excavation having the desired curved wall configuration; placing formwork assembly as described above within the excavation; adjusting the locating means to shape the flexible panel to the desired configuration in spaced relationship with the wall of the excavation; placing concrete between the form surface of the flexible panel and the excavated wall, and subsequently removing said formwork assembly from the formed wall portion.

In a further aspect this invention resides broadly in a method of constructing a concrete reservoir wall including: supporting formwork assembly, as described above, on the ground with the panel substantially upright so as to form the inner formwork for a continuous reservoir wall, connecting further form means to said formwork assembly in outwardly spaced relationship with said form surface; placing concrete between said formwork assembly and said form means, and subsequently stripping said formwork assembly and said form means from the formed reservoir wall.

Spacer means may be provided between the formwork and the form means. This may include upper and lower through bolts extending through apertures in the inner and outer walls and arranged in radially aligned configuration about the upper and lower marginal edge portions of the walls whereby after a wall section has been cast between the form walls, the latter may be released and moved to an elevated position with the upper through bolts in the existing wall section aligned with the lower apertures in the form walls. The inner and outer form walls may be formed in single flexible lengths adapted to be bent to the desired configuration or they may be formed in modules adapted to be connected together to form the inner and outer form walls.

In order that this invention may be more readily understood and put into practical effect, reference will now be made to the accompanying drawings which illustrate a preferred embodiment of the invention, wherein.

Figure 1:
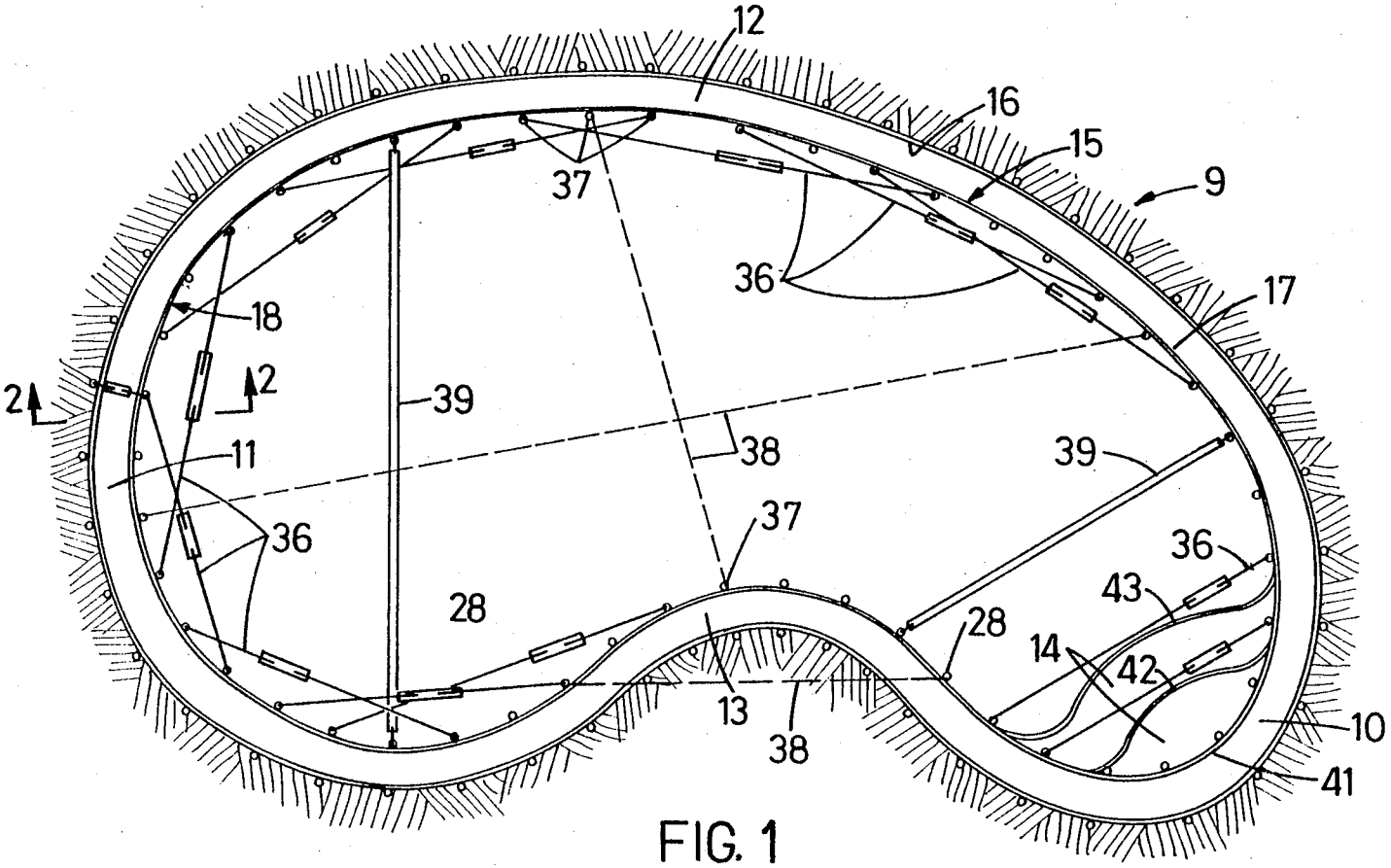
FIG. 1 is a plan view of a typical arrangement of formwork according to this ivnention set up for forming an inground concrete pool.

FIGS. 1 to 6 of the drawings illustrate the construction of an inground reinforced concrete pool 9 having a kidney shaped plan and including opposed curved end wall sections 10 and 11 interconnected by an intermediate curved wall section 12 and an external curved wall section 13. A pair of steps 14 are formed at the smaller curved end 10. The pool wall is formed by pouring or pumping concrete into the space between the framework assembly 15 and the excavated earth wall 16.

The formwork assembly 15 includes a flexible panel assembly 18 which extends about the wall 16 of the excavation in spaced relationship therewith and which provides a smooth form surface 17 against which the exposed wall surface of the pool 9 is formed. The panel assembly 18 is supported on tubular spacers 19 at regular intervals which are supported on chairs 20 placed on bricks 21 or the like arranged at the required level around the outer lip 16 of the pool floor excavation. The panel assembly 18 extends continuously around the excavated wall 16 and it is provided with regularly spaced apart vertically extending reinforcing sockets 22 on its outer surface into which the central prong 23 of fork-like supporting brackets 24 may be inserted. The lower portions of the outer prongs 25 of the brackets 24 also engage in locating sockets 22A formed on the lower part of the panel 18 at opposite sides of the reinforcing sockets 22.

Figure 4:
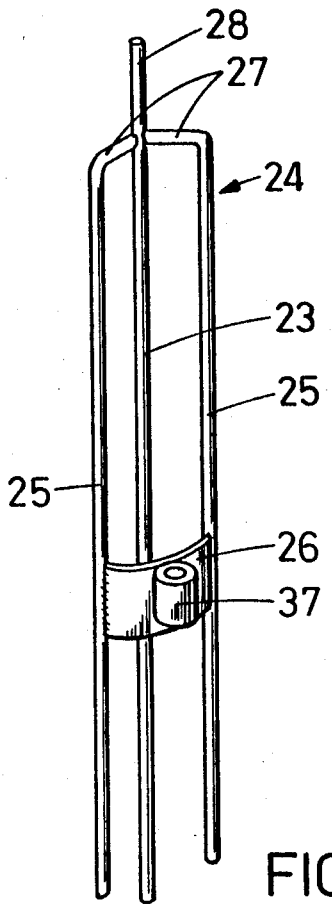
FIG. 4 is a perspective view of a typical tie rod mounting adaptor.
Figure 6:
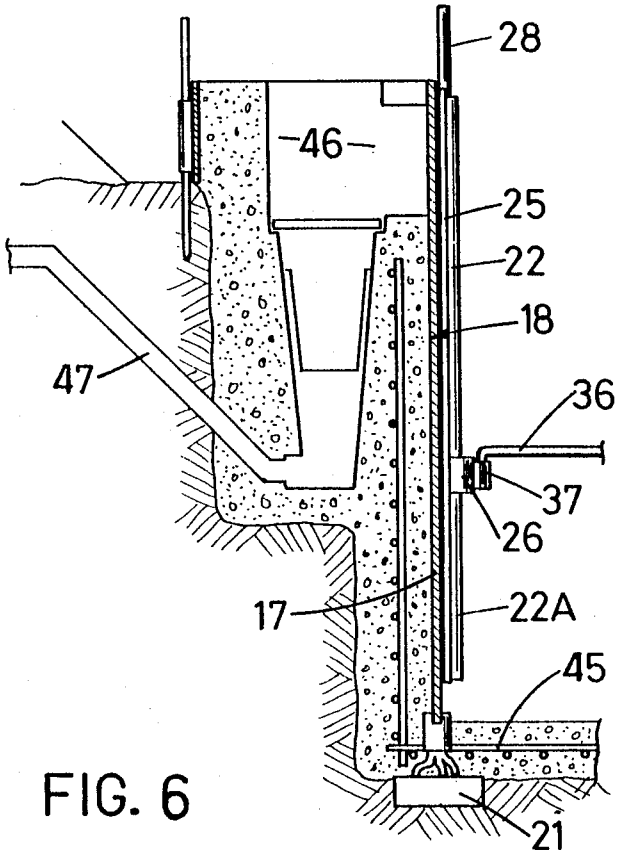
FIG. 6 illustrates the skimmer box connection details.

Referring to FIG. 4 it will be seen that the exposed upper portions of the legs 25 of each bracket 24 are interconnected by an arched bridging plate 26 and offset shoulder portions 27. A mounting socket 37 is fixed to the bridging plate 26. The shoulders 27 are off-set at various angles to suit the curvature of particular wall section at which they are located. The brackets 24 may be colour coded for correct positioning to suit the various wall curvatures. The stem 23 extends upwardly beyond the shoulder members 27 to provide a further mounting 28 for a fixed length connecting rod 29 adapted to hold an outer flexible flange former 30 in constant spaced relationship with the panel assembly 18. The anchor plates 26 are disposed below the central position of the panel assembly 18 so as to provide extra support for the lower portions of the panels 18 which are stiffened by the short sockets 22A and the full length sockets 22.

Figure 2:
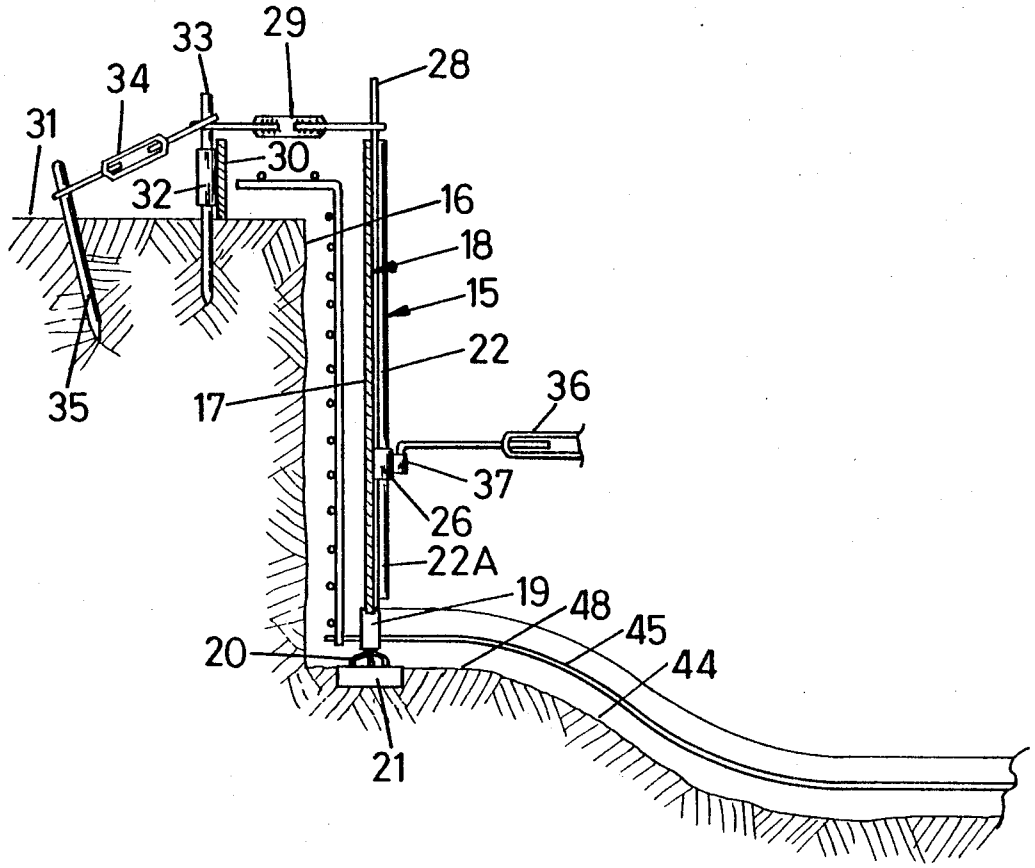
FIG. 2 illustrates an enlarged cross-sectional view taken along the line 2—2 of FIG. 1.
Figure 3:
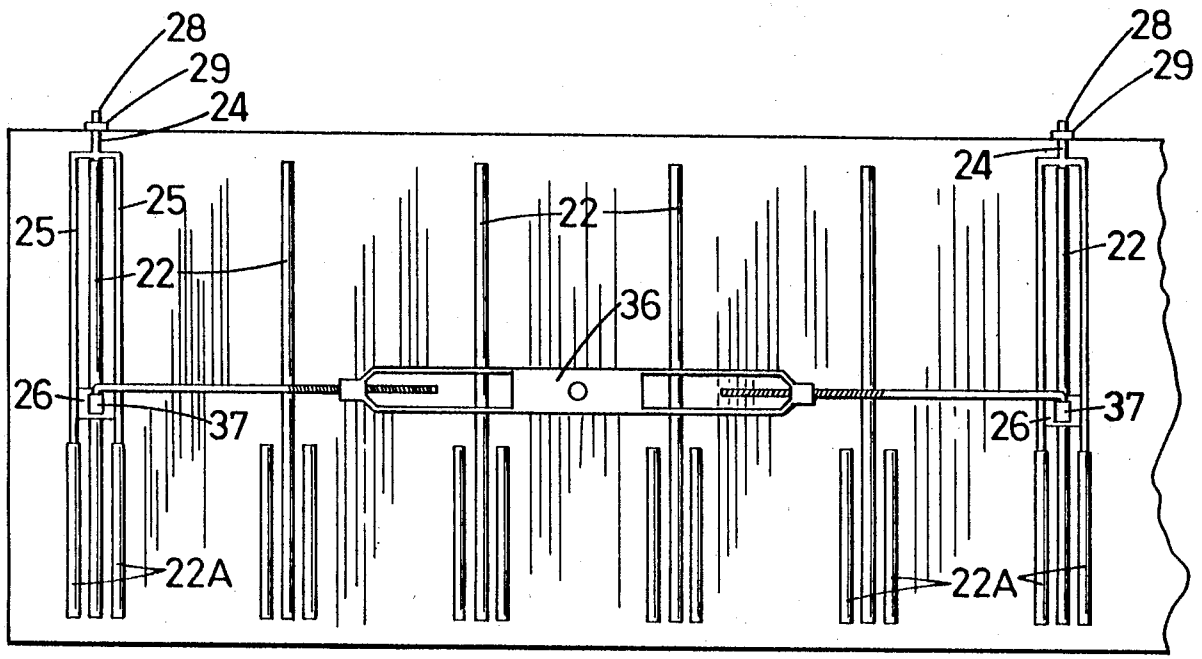
FIG. 3 is a side elevational view illustrating the connection of a tie rod with the flexible panel.

As can be seen in FIG. 2 the flange former 30 sits on the levelled ground surface 31 about the excavation and it provides the outer formwork for a constant width flange about the top of the pool 9. The former 30 is also provided with spaced sockets 32 through which pegs 33 may be driven to secure it in place. An adjustable turnbuckle 34 is positioned between these pegs 33 and a ground stake 35 so that the inclination of the supporting brackets 24 may be readily adjusted, it being important that the wall is plumb so that the wall circumference is constant from top to bottom. This is necessary for subsequent simple and effective tiling of the wall. The flexible panel assembly 18, may have a height of 1.1 m and it may be formed in modules of 9, 7, 6, 4.5, 3 and 2 meter sections, while the former 30 may have a height of between 150 and 300 mm.

The desired shape of the panel assemblies 18 is maintained by appropriate adjustment of the overlapping tie rods 36 which extend between the sockets 37 on the bridging plates 26. Each tie rod 36 overlaps at least one bracket 24, as can be seen in FIG. 1, whereby in effect the panel 18 is formed into a series of overlapping substantially rigid arched segments which interconnect to form the desired shape, which is adjustable by varying the lengths of the tie rods 36. These tie rods 36 extend across all the internal curves in the wall panel assembly 18. The external curve 13 is maintained by tension wires (shown dotted at 38) extending between opposed sockets 37 or between spaced mountings 28. Longer tubular props 39 may be provided to maintain the required shape, particularly at the small end 10 where the steps 14 are formed. The tie rods 36 and the props 39 are length adjustable so that the panel 18 may be pushed or pulled into the desired shape corresponding to the excavated hole. Panel modules may be added to or removed from the wall panel 18 until the required circumferential length is achieved.

Figure 5:
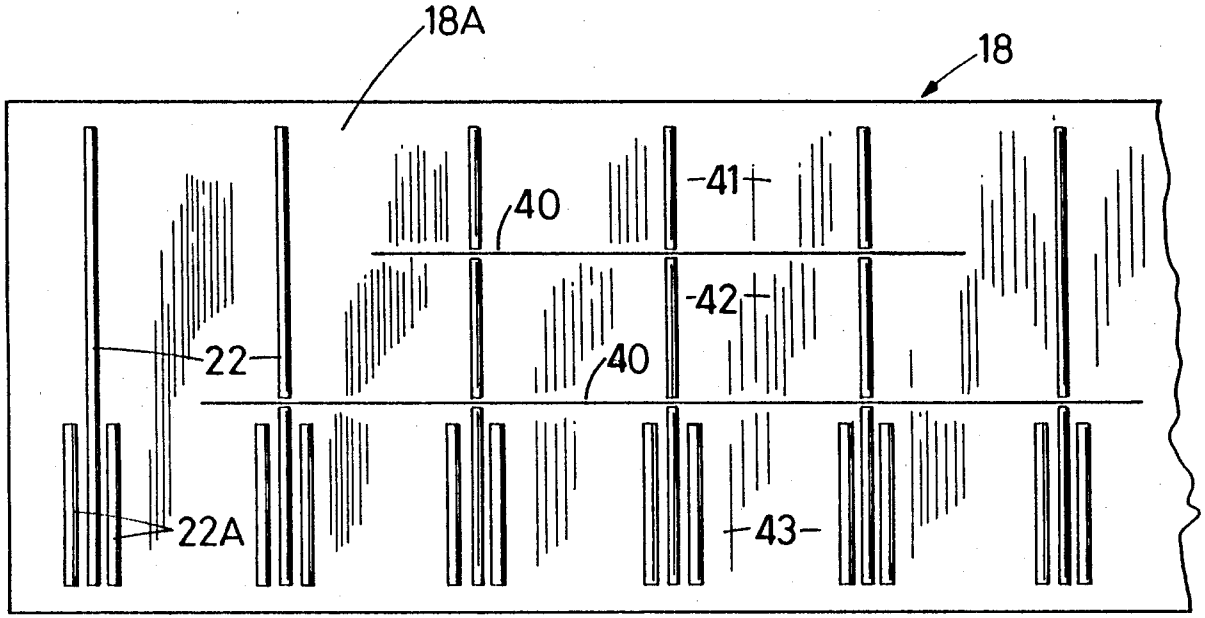
FIG. 5 is a side view of a typical flexible panel having slits to provide step formers.

The formwork for the steps, as shown in FIG. 5, is provided by slitting a panel module 18*a* as indicated at 40 so as to cut a section of the panel module into an upper piece 41, an intermediate piece 42 and a lower piece 43. The steps 14 are then formed by pulling out the intermediate and lower pieces 42 and 43 to the shape shown in FIG. 1.

The floor 44 of the pool 9 may be excavated to any desired configuration and suitable reinforcing mesh 45 is positioned above the floor excavation and behind the wall formwork in conventional manner. The necessary plumbing, including the skimmer box 46 and the return line 47 is placed prior to the concrete being poured. The concrete may be poured in stages or continuously as desired. Suitably concrete at approximately 80 slump is used so that continuous vibration will not be necessary and so that sufficient concrete will flow beneath the panel 18 to start the safety ledge 48. The supports 19 may then be removed. If interruption occurs in the pour the interface may require treatment to ensure a high quality bond between the successive pours. The formwork may be removed after about four hours leaving a high quality off the form finish which may be painted or tilted or otherwise treated as desired.

Figure 7:
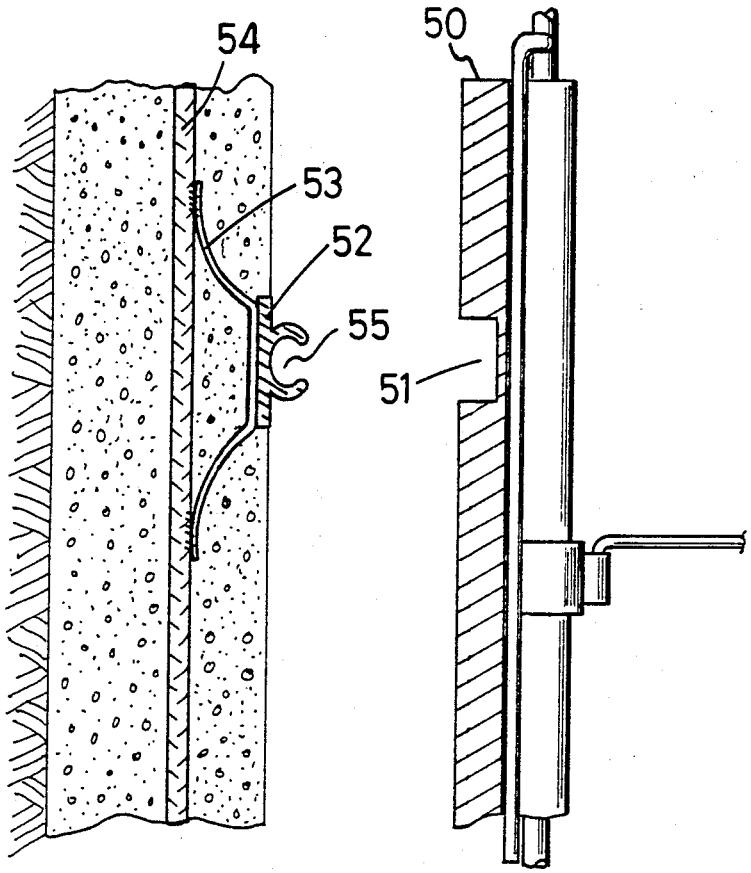
FIG. 7 is an enlarged cross-sectional view illustrating details of a vinyl liner retention track mounting and formwork details.
Figure 9:
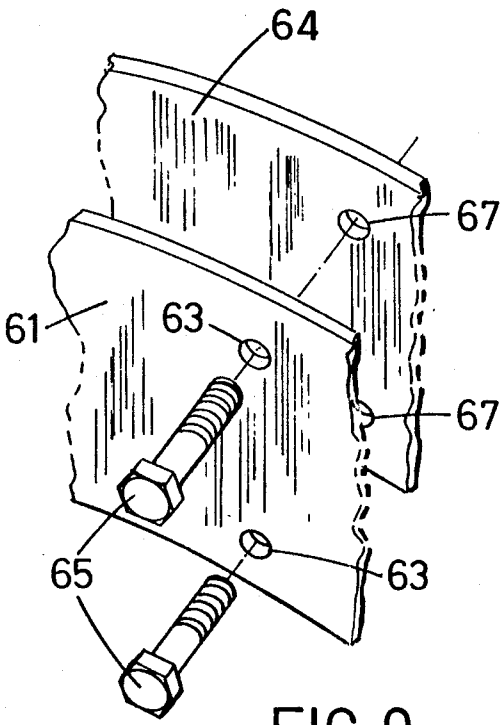
FIG. 9 is a broken away perspective view of portion of the wall formwork.

If the pool is to be used with salt water and a vinyl liner is required, then as illustrated in FIG. 7, the formwork 50 is provided with a recess 51 around its top edge portion into which an extruded track section 52 may extend. This section 52 is rivetted to stainless anchor cleats 53 which in turn connect to the reinforcing steel 54 as illustrated. A suitable filler cord in placed in the track 55 prior to concrete pouring and later stripped to provide a clean track 55 into which the vinyl liner may be clipped in known manner. This track is positioned accurately beneath the top edge of the formwork 50 whereby the vinyl liner may extend from beneath the lower edge of a course of tiles secured around and above the waterline of the pool.

Construction of the pool proceeds as follows: Firstly the excavation is formed to the required shape. The excavated walls are maintained as near as possible to the vertical to minimise concrete usage. The bricks 21 are then placed and levelled and the wall mesh is placed. The flexible panel modules are coated with a release agent and set up on the bricks 21, supported by the chairs 20 and the removable supports 19. The panel modules are then bolted together to form the continuous wall panel assembly 18. For this purpose the opposed ends of the panel modules are provided with apertured return flanges which may be bolted together. The steps 14 are pulled out and the supporting brackets 24 secured in the sockets 22. These stiffen the wall panel assembly 18 and provide the mountings 37 for the tie rods 36 which are then secured and adjusted until the desired shape is achieved. Interim ties may be used to hold the panel assembly 18 while its shape is being adjusted. The bond beam or flange formwork is then set up and the formwork plumbed. The necessary plumbing is then placed in position and connected. The concrete may then be poured to form the walls behind the formwork and with the floor. The formwork may be stripped after about 4 hours and the walls finished as required.

This invention may be used for constructing the wall of inground and above ground pools and of course the walls could be formed of fibreglass reinforced plastic if desired such as by laminating the walls against the form face of the panel assembly 18. Furthermore the flexible formwork may be used in conjunction with rigid formwork or for forming a wall part of an otherwise free formed reservoir.

Figure 8:
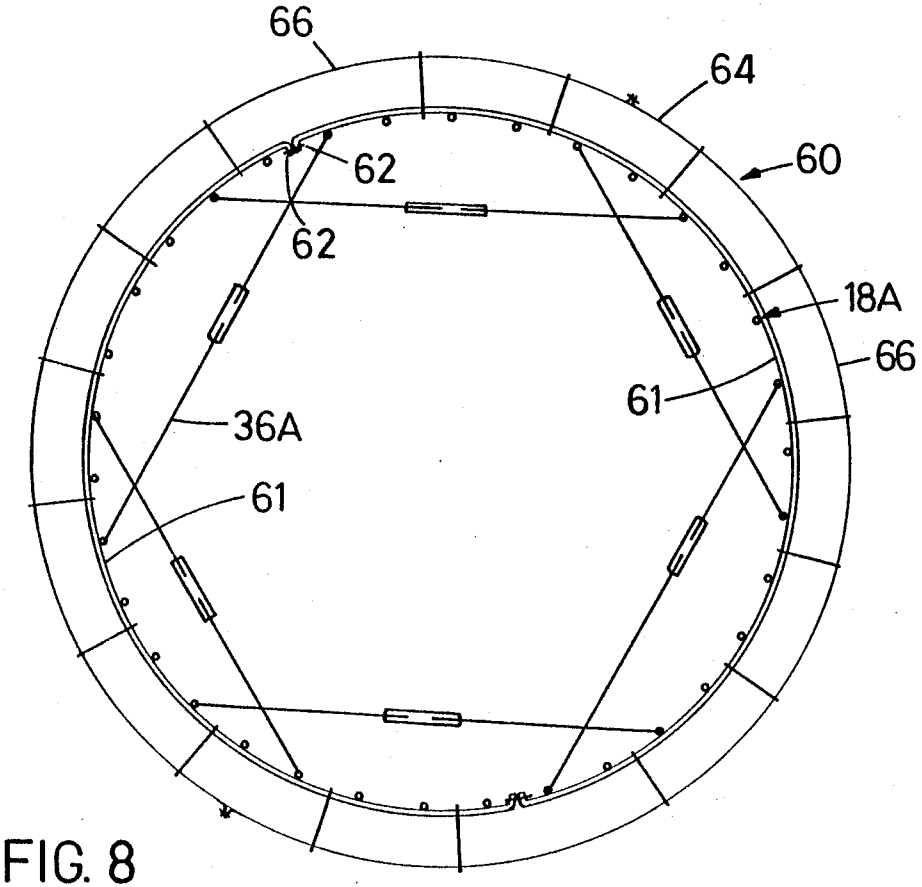
FIG. 8 is a plan view of formwork arranged for constructing a circular reservoir.

The reservoir formwork 60 illustrated in FIG. 8 comprises an inner panel assembly substantially as described with reference to FIGS. 1 to 7 and comprised of a plurality of segments 61 having flanged ends 62 whereby they may be bolted together into a circular configuratin. Adjustable tensioners or tie rods 36A are used to maintain the desired circular shape and each segment is provided with a series of equally spaced apertures 63 around its top and bottom edges whereby an exterior flexible form 64 may be bolted thereto by through bolts 65 in spaced relationship. The outer form 64 is also comprised of a plurality of flanged segments 66 which are bolted together to form the desired circular shape former. This former is also provided with a series of spaced apertures 67 around its top and bottom edges for the through bolts 65. Preferably the apertures in each inner panel 61 and the exterior panel 64 are arranged in vertically aligned pairs of apertures in each wall, the apertures 63 and 67 being in radial alignment.

A reservoir is formed by placing concrete between the forms 61 and 64 and then after the concrete has sufficiently cured releasing the through bolts 65 and then either slipping the formwork upwardly so that the lower apertures 63 and 67 align with the upper through bolt positions in the formed concrete wall portion whereby they may be bolted together about the top portion of the wall and extending upwardly therefrom to enable further concrete to be poured. Alternatively the form segments can be unbolted and moved to their new positions. This process can be carried out until a desired wall height is achieved.

It is to be understood that the above has been given only by way of illustrative example of the invention and that all such modifications and variations thereto as would be apparent to persons skilled in the art are deemed to fall within the broad scope and ambit of the invention as is defined in the appended claims.

I claim:

1. Formwork assembly against which a wall may be molded, comprising:

an elongate rectangular flexible panel having a form surface at one side of said panel;

a plurality of panel stiffeners spaced along the opposite side of said panel, said stiffeners including a tubular socket mounted to said panel, a rigid fork connector having a central prong slidably engageable in said tubular socket and outer prongs slidably engageable in further sockets fixed to a lower portion of said panel and a bridging member extending between said outer prongs;

a plurality of connector means each being mounted on a respective bridging member for connecting locating means thereto for holding said panel in a selected configuration, said locating means including adjustable elongate turn-buckles spanning between and connecting to a pair of said connector means and in overlapping relationship with connector means intermediate said pair of connector means, to thereby maintain a panel intermediate said pair of connector means in a selected configuration.

2. Formwork assembly according to claim 1, wherein said rigid fork connector has a stem which extends outwardly beyond said panel to provide a mounting for a locating means for positioning said panel.

3. Formwork assembly according to claim 1, wherein said flexible panel is formed of fiberglass reinforced plastics material.

4. Demountable formwork against which a reservoir wall may be formed, comprising:

an elongate substantially rectangular flexible panel having a form surface at one side of said panel;

a plurality of detachable elongate supporting brackets mounted to and being spaced along the opposite side of said panel and having mounting means thereon intermediate longitudinal edges of said panel for supporting length adjustable tie rods, said length adjustable tie rods extending between respective pairs of said supporting brackets and in overlapping relationship with one another; and retaining means on said opposite side for retaining said supporting brackets each said retaining means including an elongate socket mounted to said panel and each said supporting bracket comprises a rigid fork connector having a central prong which is slidably engageable in said socket and outer prongs which are engageable in further sockets fixed to a lower portion of said panel and wherein said mounting means is supported on a bridging member extending between said outer prong.

5. Demountable formwork according to claim 4, wherein said central prong extends upwardly beyond said panel.

* * * * *